US010280052B2

(12) United States Patent
Chiu

(10) Patent No.: US 10,280,052 B2
(45) Date of Patent: May 7, 2019

(54) VEHICLE PARKING APPARATUS

(71) Applicant: Shih-Tsai Chiu, Pingtung (TW)

(72) Inventor: Shih-Tsai Chiu, Pingtung (TW)

( * ) Notice: Subject to any disclaimer, the term of this patent is extended or adjusted under 35 U.S.C. 154(b) by 36 days.

(21) Appl. No.: 15/624,712

(22) Filed: Jun. 16, 2017

(65) Prior Publication Data

US 2017/0283226 A1 Oct. 5, 2017

(30) Foreign Application Priority Data

Jun. 21, 2016 (CN) ..... 2016 2 0610836 U

(51) Int. Cl.
*B66F 7/02* (2006.01)
*E04H 6/06* (2006.01)
*E04H 6/18* (2006.01)

(52) U.S. Cl.
CPC ..... *B66F 7/02* (2013.01); *E04H 6/06* (2013.01); *E04H 6/188* (2013.01)

(58) Field of Classification Search
CPC ..... B66F 7/02; E04H 6/06; E04H 6/188
USPC ..... 187/210; 414/228, 229, 233
See application file for complete search history.

(56) References Cited

U.S. PATENT DOCUMENTS 3,101,130 A * 8/1963 Bianca ..... B66B 11/08 187/244
5,566,783 A * 10/1996 Yamashita ..... B66B 11/009 187/210
10,053,885 B2 * 8/2018 Stokes, Sr. ..... E04H 6/06
2011/0041267 A1 * 2/2011 Sun ..... B66F 7/0633 14/77.1
2016/0193538 A1 * 7/2016 Cantu ..... B66F 7/02 182/141

FOREIGN PATENT DOCUMENTS

JP 04254671 A * 9/1992
JP 04293867 A * 10/1992

* cited by examiner

*Primary Examiner* — James Keenan

(57) ABSTRACT

A vehicle parking apparatus includes two front stanchions and two rear stanchions all mounted on a base frame; a top support interconnecting the front stanchions and the rear stanchions; a platform having a rear end moveably secured to the rear stanchions, and two sides moveably secured to the front stanchions; and two elevating assemblies, each including a first pulley on an upper portion of one rear stanchion, a second pulley fixedly disposed on either side of the top support, a third pulley on either side of the platform, a fourth pulley fixedly disposed on a bottom of one rear stanchion, the fourth pulley being driven by a motor, and a rope having one end secured to the base frame, and the other end secured to the top support, the rope sequentially passing through the first pulley, the fourth pulley, the second pulley, and the third pulley.

1 Claim, 3 Drawing Sheets

VEHICLE PARKING APPARATUS

BACKGROUND OF THE INVENTION

1. Field of the Invention

The invention relates to car parking systems and more particularly to a pulley based vehicle parking apparatus.

2. Description of Related Art

A conventional vehicle parking apparatus comprises a base frame including two spaced stanchions each having a generally vertically extending portion secured to the base frame at its lower end, and an angled upper portion; a platform mounted on the base frame and configured to receive a vehicle, the platform including slide means on opposite sides thereof respectfully engaged with elongated guide means of the spaced stanchions for substantially free reciprocation of the platform along the length of the stanchions, and including inwardly directed flanges disposed at the free ends thereof for defining channels forming the elongated guide means for receiving the slide means, and wherein the slide means comprises upper and lower vertically spaced rollers respectfully secured to the platform and configured to freely reciprocate in the channels; and reversible elevating means supported by the stanchions and connected to the platform for elevating the platform with a first vehicle thereon from an initial, horizontal position to an elevated position.

While the apparatus enjoys its success in the market, continuing improvements in the exploitation of vehicle parking apparatus of this type are constantly being sought.

SUMMARY OF THE INVENTION

It is therefore one object of the invention to provide a vehicle parking apparatus comprising a base frame; two spaced front stanchions mounted on the base frame; two spaced rear stanchions mounted on the base frame; a top support interconnecting the front stanchions and the rear stanchions; a horizontal platform having a rear end moveably secured to and configured to lift or lower along the rear stanchions, and two sides moveably secured to and configured to lift or lower along the front stanchions; a motor disposed at a bottom of one of the rear stanchions; and two elevating assemblies, each including a first pulley moveably disposed on an upper portion of one of the rear stanchions, a second pulley fixedly disposed on either side of the top support, a third pulley moveably disposed on either side of the platform, a fourth pulley fixedly disposed on a bottom of one of the rear stanchions, the fourth pulley being operatively driven by the motor, and a rope having one end secured to the base frame, and the other end secured to the top support, the rope sequentially passing through the first pulley, the fourth pulley, the second pulley, and the third pulley; wherein a first activation of the motor counterclockwise rotates the fourth pulleys, pulls down the ropes, and lower the first pulleys, the third pulleys, and the platform until the platform contacts the base frame; and wherein a second activation of the motor clockwise rotates the fourth pulleys, pulls up the ropes, and lift the first pulleys, the third pulleys, and the platform until the platform reaches a predetermined elevated position.

The above and other objects, features and advantages of the invention will become apparent from the following detailed description taken with the accompanying drawings.

DETAILED DESCRIPTION OF THE INVENTION

Figure 1:
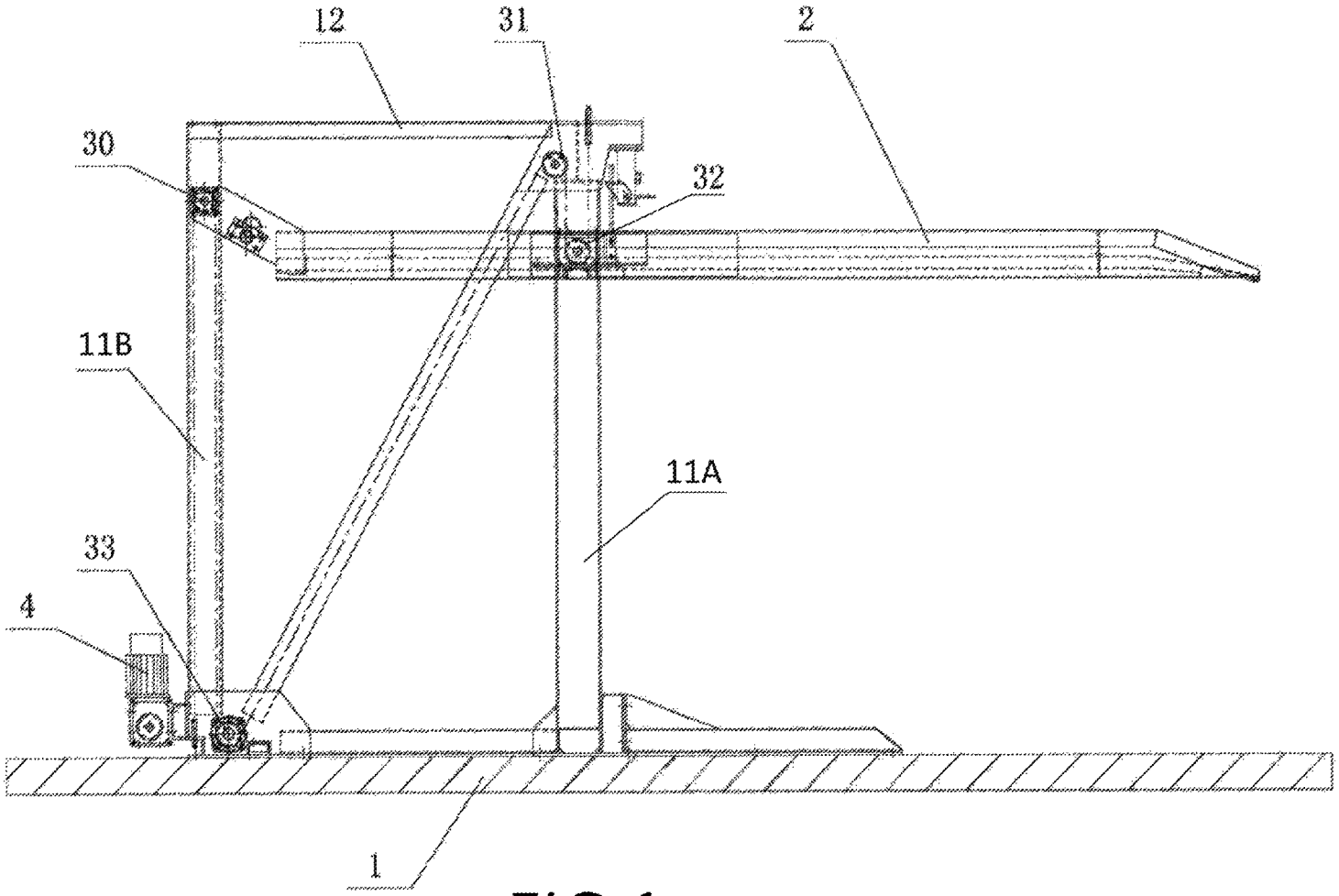
FIG. 1 is a side elevation of a vehicle parking apparatus of the invention.
Figure 2:
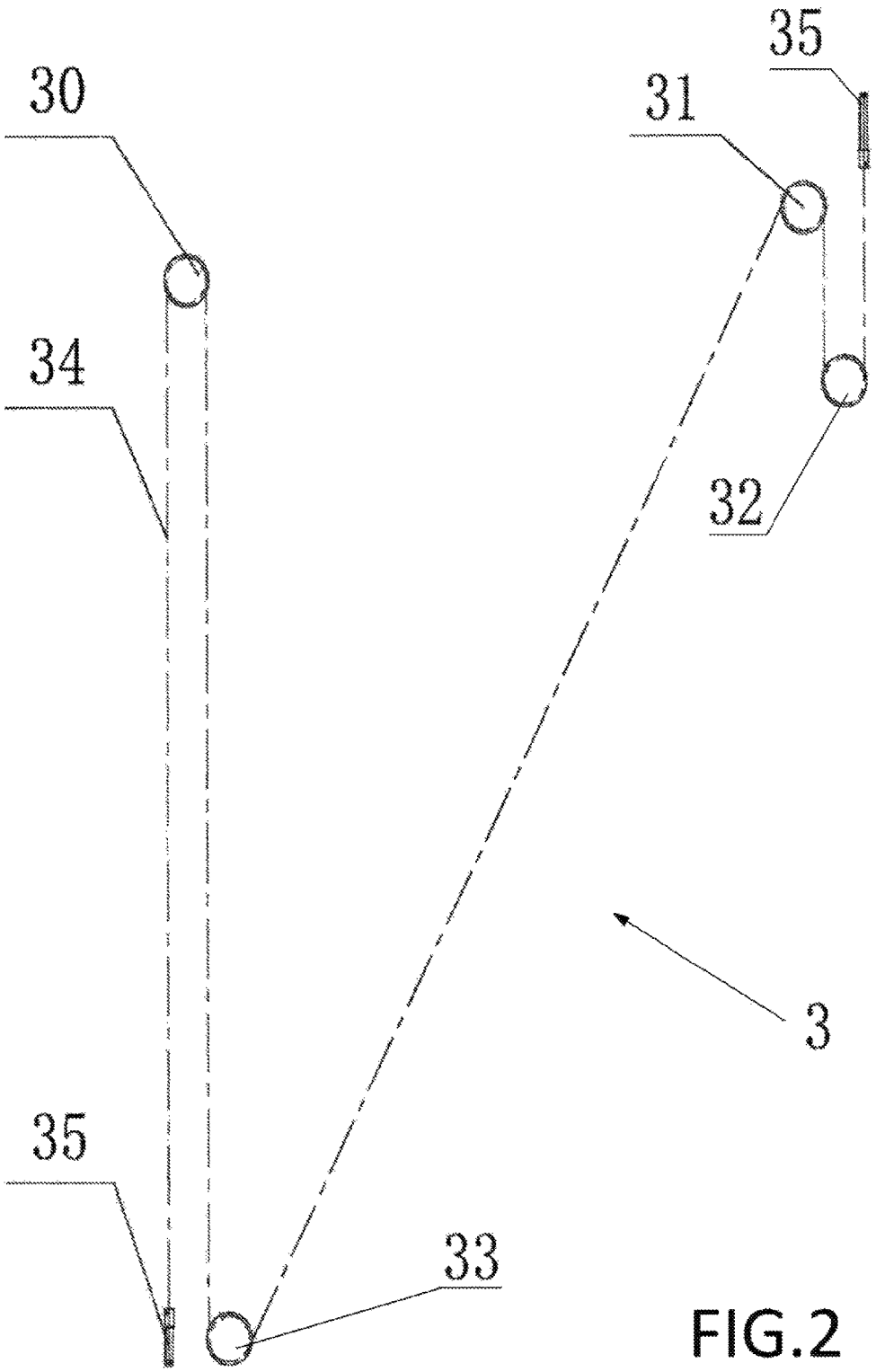
FIG. 2 schematically shows the elevating assembly.

Referring to FIGS. 1 and 2, a vehicle parking apparatus in accordance with the invention comprises a base frame 1 on the ground, two spaced front stanchions 11A mounted on the base frame 1, two spaced rear stanchions 11B mounted on the base frame 1, a top support 12 interconnecting the front stanchions 11A and the rear stanchions 11B, a horizontal platform 2 dimensioned to receive a vehicle and having a rear end moveably secured to and configured to lift or lower along the rear stanchions 11B, and two sides moveably secured to and configured to lift or lower along the front stanchions 11A, a motor 4 disposed at a bottom of one of the rear stanchions 11B, and two elevating assemblies 3, each including a first pulley 30 moveably disposed on an upper portion of the rear stanchion 11B, a second pulley 31 fixedly disposed on either side of the top support 12, a third pulley 32 moveably disposed on either side of the platform 2, a fourth pulley 33 fixedly disposed on a bottom of the rear stanchion 11B, the fourth pulley 33 being operatively driven by a motor shaft (not shown) of the motor 4, and a rope 34 having one end connected a fastener 35 which is secured to the base frame 1, and the other end connected to another fastener 35 which is secured to the top support 12, the rope 34 sequentially passing through the first pulley 30, the fourth pulley 33, the second pulley 31, and the third pulley 32.

An operation of the invention is described in detail below. An employee may press a forward button of a switch to activate the motor 4 which in turn counterclockwise rotates the fourth pulleys 33. Further, the ropes 34 are pulled down. And in turn, the first pulleys 30, the third pulleys 32, and the platform 2 lower until the platform 2 contacts the base frame 1. Thereafter, a driver may drive a vehicle onto the platform 2 and park same. Thereafter, the employee may press a reverse button of the switch to activate the motor 4 which in turn clockwise rotates the fourth pulleys 33. Further, the ropes 34 are pulled up. And in turn, the first pulleys 30, the third pulleys 32, and the platform 2 lift until the platform 2 reaches its predetermined elevated position.

Figure 3:
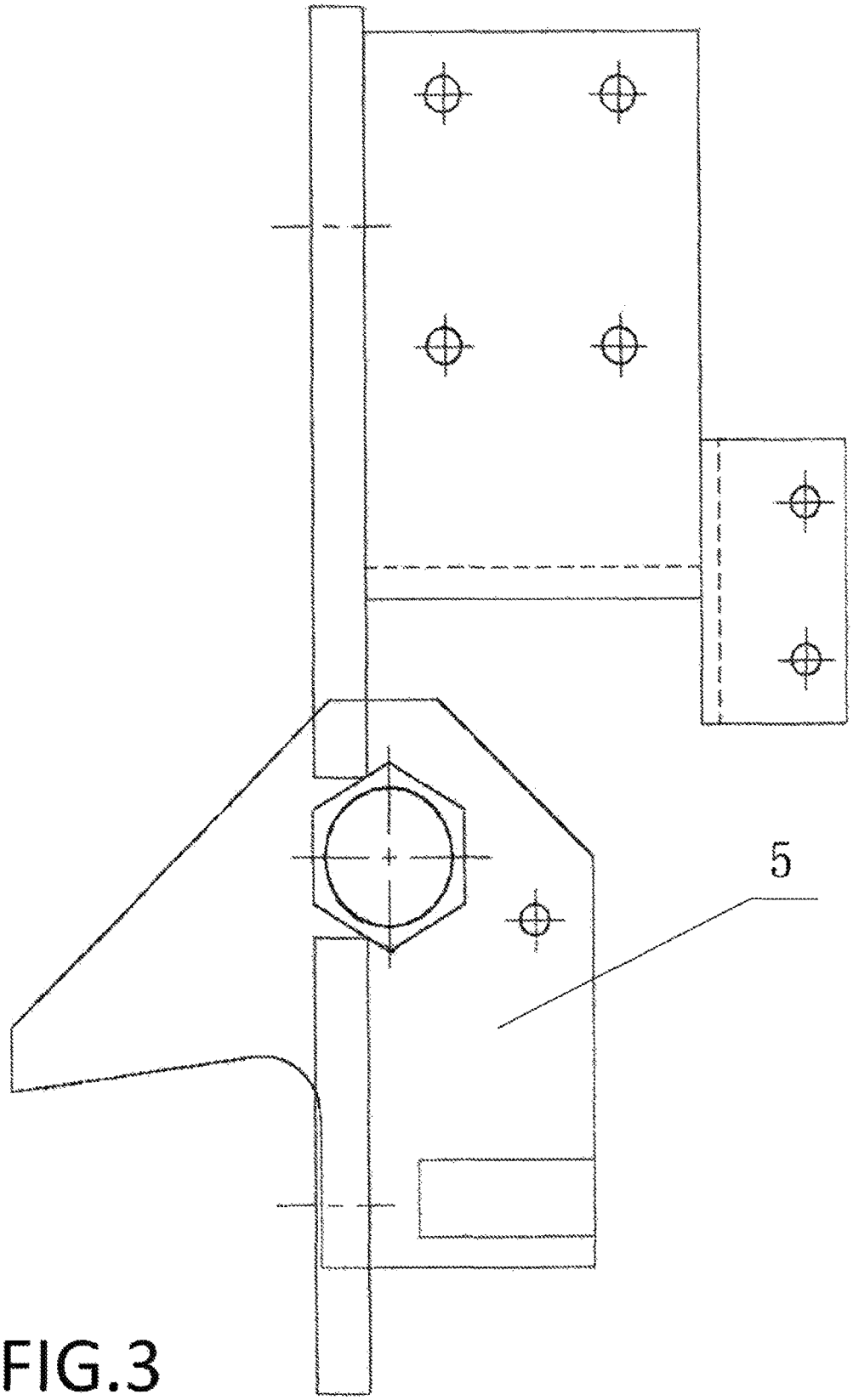
FIG. 3 is a side elevation of a safety hook according to the invention.

Referring to FIG. 3, a safety hook 5 of the invention is shown. The safety hook 5 is provided to catch a falling platform 2 if such occurs in the lowering or lifting operation of the platform 2.

While the invention has been described in terms of preferred embodiments, those skilled in the art will recognize that the invention can be practiced with modifications within the spirit and scope of the appended claims.

What is claimed is:

1. A vehicle parking apparatus comprising:

a motor;

a base frame;

two spaced front stanchions mounted on the base frame;

two spaced rear stanchions mounted on the base frame;

a top support interconnecting the front stanchions and the rear stanchions;

a horizontal platform having a rear end moveably secured to and configured to lift or lower along the rear stanchions, and two sides moveably secured to and configured to lift or lower along the front stanchions; and two elevating assemblies, each including a first pulley moveably disposed on an upper portion of one of the rear stanchions, a second pulley fixedly disposed on either side of the top support, a third pulley moveably disposed on either side of the platform, a fourth pulley fixedly disposed on a bottom of one of the rear stanchions, the fourth pulley being operatively driven by the motor, and a rope having one end secured to the base frame, and the other end secured to the top support, the rope sequentially passing through the first pulley, the fourth pulley, the second pulley, and the third pulley;

wherein a first activation of the motor counterclockwise rotates the fourth pulleys, pulls down the ropes, and lowers the first pulleys, the third pulleys, and the platform until the platform contacts the base frame; and wherein a second activation of the motor clockwise rotates the fourth pulleys, pulls up the ropes, and lifts the first pulleys, the third pulleys, and the platform until the platform reaches a predetermined elevated position.

* * * * *